US006336800B1

(12) United States Patent
Kim et al.

(10) Patent No.: US 6,336,800 B1
(45) Date of Patent: Jan. 8, 2002

(54) ROTARY COMPRESSOR

(75) Inventors: Jin Dong Kim; Kwang Ha Suh, both of Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/627,063

(22) Filed: Jul. 27, 2000

(30) Foreign Application Priority Data

Jul. 28, 1999 (KR) ..... 99-30800

(51) Int. Cl.[7] ..... F03C 2/00

(52) U.S. Cl. ..... 418/63; 418/64; 418/65; 418/66; 418/67; 418/180

(58) Field of Search ..... 418/63, 64, 65, 418/66, 67, 180

(56) References Cited

U.S. PATENT DOCUMENTS

| | | | | | |
|---|---|---|---|---|---|
| 2,612,311 | A | * | 9/1952 | Warrick et al. | 418/63 |
| 4,537,567 | A | * | 8/1985 | Kawaguchi et al. | 418/180 |
| 4,881,879 | A | * | 11/1989 | Ortiz | 418/63 |
| 4,884,956 | A | * | 12/1989 | Fujitani et al. | 418/63 |
| 4,960,372 | A | * | 10/1990 | Scheldorf et al. | 418/63 |

FOREIGN PATENT DOCUMENTS

| | | | | | |
|---|---|---|---|---|---|
| DE | 936214 | A | * | 3/1954 | 418/63 |
| EP | 184281 | A | * | 6/1986 | 418/63 |
| JP | 57-070989 | A | * | 1/1982 | 418/150 |
| JP | 2-308997 | A | * | 12/1990 | 418/63 |
| JP | 5-079482 | A | * | 3/1993 | 418/63 |

* cited by examiner

*Primary Examiner*—Thomas Denion
*Assistant Examiner*—Theresa Triem
(74) *Attorney, Agent, or Firm*—Birch, Stewart, Kolasch & Birch, LLP

(57) ABSTRACT

A rotary compressor of the low operational noise type is disclosed. This compressor consists of a casing, a rotating shaft set within the casing, a roller eccentrically fixed to the rotating shaft and eccentrically, rotatably set within a cylinder so as to form a variable suction chamber and a variable compression chamber within the cylinder. The compressor also has a bypass passage, which is formed on the internal surface of the cylinder at a position around the refrigerant exhaust stroke initiating point, thus allowing the compression and exhaust chambers to communicate with each other through the bypass passage and allowing highly compressed refrigerant to be fed from the compression chamber back into the suction chamber at the initial stage of each exhaust stroke. Therefore, the compressor of this invention effectively reduces excessive pressure pulsation generated at the initial stage of each exhaust stroke, thereby effectively reducing impact exciting force caused by the pressure pulsation within the compression chamber of the cylinder and effectively reducing impact vibration and pulsation noise.

3 Claims, 4 Drawing Sheets

ROTARY COMPRESSOR

BACKGROUND OF THE INVENTION

1. Field of the Invention

The present invention relates to rotary compressors and, more particularly, to a rotary compressor of the low operational noise type, having a bypass passage on the internal surface of its cylinder at a position around a fluid exhaust stroke initiating point to effectively reduce excessive pressure pulsation generated at the initial stage of an exhaust stroke, thus effectively reducing impact exciting force caused by the pressure pulsation within the compression chamber of the cylinder and effectively reducing pulsation noise having a wide frequency band.

2. Description of the Prior Art

As well known to those skilled in the art, compressors are machines used for compressing fluid, such as liquid or gas, to a desired pressure and have been preferably and widely used for a variety of applications. Such compressors are recognized as very important elements in a variety of refrigeration systems, such as air conditioners or refrigerators, since the compressors are used for compressing refrigerant of refrigeration cycles and determine the operational capacities and operational efficiencies of such refrigeration systems. Conventional compressors have been classified into two types: rotary compressors and scroll compressors. Of the two types, the scroll compressors are designed to compress refrigerant by a rotating action of a rotatable scroll, operated in conjunction with a drive unit, relative to a fixed scroll. On the other hand, the rotary compressors compress refrigerant by a roller, which is operated in conjunction with a drive unit and is eccentrically rotated within the bore of a cylinder.

FIGS. 1 and 2 show the construction of a conventional rotary compressor. As shown in the drawings, the conventional rotary compressor comprises a casing 10 provided with both a refrigerant inlet port 10*a* for introducing refrigerant into the casing 10 and a refrigerant outlet port 10*b* for discharging compressed refrigerant from the casing 10. A stator 11 is fixed within the casing 10, while a rotor 12 is positioned to be electromagnetically rotatable relative to the stator 11 when it is electrically activated. A rotating shaft 13 having an eccentric portion (13') is integrated with the central axis of the rotor 12 and is rotatable along with the rotor 12. A roller 17 is fixed to the eccentric portion (13') of the rotating shaft 13 and set within the bore 16*a* of a cylinder 16. The cylinder 16 has a suction port 21 and an exhaust port 22 and compresses working fluid, sucked into the bore 16*a* through the suction port 21, in accordance with an eccentric rotating action of the roller 17 within the bore 16*a* and discharges the compressed fluid from the bore 16*a* through the exhaust port 22.

A vane 18 is provided within the bore 16*a* of the cylinder 16 at a position around the exhaust port 22 and is normally biased by a spring 19 so as to elastically come into contact with the external surface of the roller 17. The above vane 18 partitions the chamber, formed between the cylinder 16 and the roller 17, into a variable suction chamber 16*b* and a variable compression chamber 16*c*. An exhaust control valve (not shown) is provided within the exhaust port 22 of the cylinder 16 and is used for controlling the port 22 so as to allow the port 22 to exhaust the compressed fluid from the cylinder 16 when the roller 17 completely rotates within the cylinder 16 at a predetermined angle. A main bearing 14 is installed at an upper position within the cylinder 16, while a sub-bearing 15 is installed at a lower position within the cylinder 16.

The above conventional rotary compressor is operated as follows: That is, when the compressor is electrically activated, the rotor 12 is electromagnetically rotated along with the rotating shaft 13 relative to the stator 11. Therefore, the roller 17 is eccentrically rotated within the cylinder bore 16*a* while coming into tangential contact with the internal surface of the cylinder 16. When the roller 17 is eccentrically rotated within the cylinder bore 16*a*, refrigerant is introduced into the bore 16*a* through the suction port 21. The refrigerant is thus gradually compressed as the compression chamber 16*c*, formed by the roller 17, the internal surface of the cylinder 16 and the vane 18, is gradually reduced in its volume due to the eccentric rotating action of the roller 17 within the cylinder bore 16*a*. When the pressure of the refrigerant reaches a predetermined reference level as it is compressed, the exhaust control valve is opened, thus allowing the compressed refrigerant to be exhausted from the cylinder 16 through the exhaust port 22. The exhausted compressed air is, thereafter, discharged from the compressor through the refrigerant outlet port 10*b* formed on the casing 10 of the compressor.

In the drawings, the reference numeral 20 denotes an accumulator.

FIG. 3 is a sectional view corresponding to FIG. 2, showing a resonator installed within the cylinder of the conventional rotary compressor. As shown in the drawing, a resonator 40, designed to reduce operational noise of a predetermined frequency band, is formed in the cylinder 16 to communicate with the exhaust port 22. Due to the resonator 40, the compressor reduces pulsation noise, caused by refrigerant gas within the cylinder 16 during a refrigerant compression stroke of the cylinder 16. The resonator 40 also prevents an undesirable quick discharging of the pressure pulsation from the cylinder 16 during a refrigerant exhaust stroke of the cylinder 16, thus reducing operational noise and vibration during the refrigerant exhaust stroke. The resonator 40 is determined in its resonating frequency band in accordance with both the shape of a resonating cavity determined by the acoustic resonance and the shape of a pressure leading passage.

Since both the shape of the resonating cavity and the shape of the pressure leading passage are fixed, the resonating frequency band of the resonator 40 for the cylinder 16 is fixed. However, since the compression chamber 16*c* is gradually reduced in its volume in a refrigerant compression stroke, the internal pressure of the compression chamber 16*c* continuously varies, with the pressure pulsation being exhausted from the cylinder 16 through the exhaust port 22. Therefore, the compressor inevitably generates operational noises having a variety of frequency bands, and so the resonator 40, having a fixed resonating frequency band, does not desirably reduce the pressure pulsation in the compressor.

In addition, lubrication oil may be undesirably introduced from the cylinder bore 16*a* into the resonating cavity of the resonator 40 at the initial stage of the operation of the compressor. In such a case, it is almost impossible to effectively remove the lubrication oil from the resonator 40 during the operation of the compressor since the pressure leading passage of the resonator 40 is positioned above the resonating cavity. The amount of lubrication oil, remaining in the resonating cavity, varies during the operation of the compressor, and changes the noise reduction characteristics of the resonator 40. Therefore, the resonator 40 does not maintain its designed noise reductirefrigeranton characteristics and fails to accomplish its desired noise reducing operational effect.

In addition, since the resonator 40 is formed on the middle portion of the exhaust line while communicating with the exhaust port 22, the quantity of refrigerant, which is undesirably remained in the compression chamber 16*c* at the final stage of a compressed refrigerant exhaust stroke and is free from exhausting compressed refrigerant from the cylinder 16, is undesirably increased. Therefore, the highly compressed refrigerant gas, remaining in the dead cavity, is undesirably fed back to the suction chamber 16*b* of the cylinder bore 16*a* after the exhaust stroke, thus causing a re-expansion of completely compressed refrigerant and deteriorating the compression efficiency of the compressor.

SUMMARY OF THE INVENTION

Accordingly, the present invention has been made keeping in mind the above problems occurring in the prior art, and an object of the present invention is to provide a rotary compressor of the low operational noise type, which has a bypass passage on the internal surface of its cylinder at a position around a fluid exhaust stroke initiating point to effectively reduce excessive pressure pulsation generated at the initial stage of each exhaust stroke, thus effectively reducing impact exciting force caused by the pressure pulsation within the compression chamber of the cylinder and effectively reducing pulsation noise having a wide frequency band.

In order to accomplish the above object, the present invention provides a rotary compressor comprising a casing, a rotating shaft set within the casing, a roller eccentrically fixed to the rotating shaft and eccentrically, rotatably set within a cylinder so as to form a variable suction chamber and a variable compression chamber within the cylinder, further comprising a bypass passage formed on the internal surface of the cylinder at a position around the refrigerant exhaust stroke initiating point, thus allowing the compression and exhaust chambers to communicate with each other through the bypass passage at the initial stage of each exhaust stroke.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION.

Figure 4:
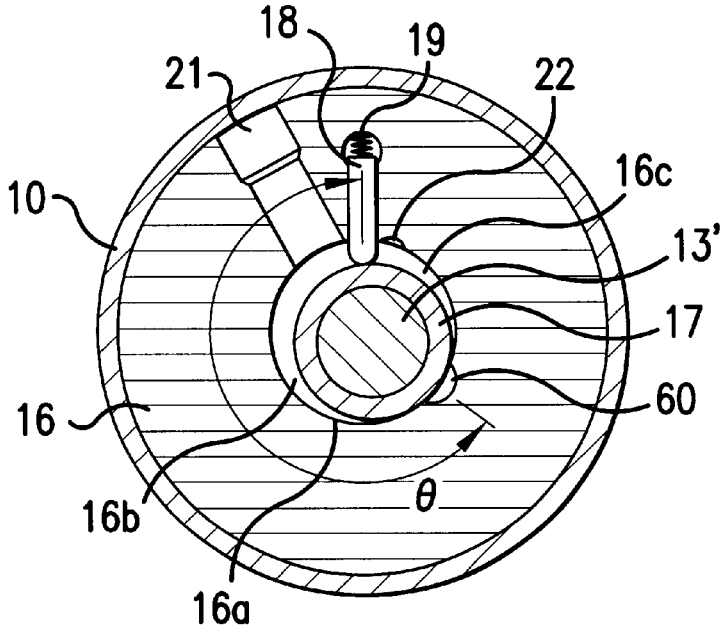
FIG. 4 is a sectional view, showing the cylinder and the eccentric roller of a rotary compressor in accordance with the preferred embodiment of the present invention.
Figure 5:
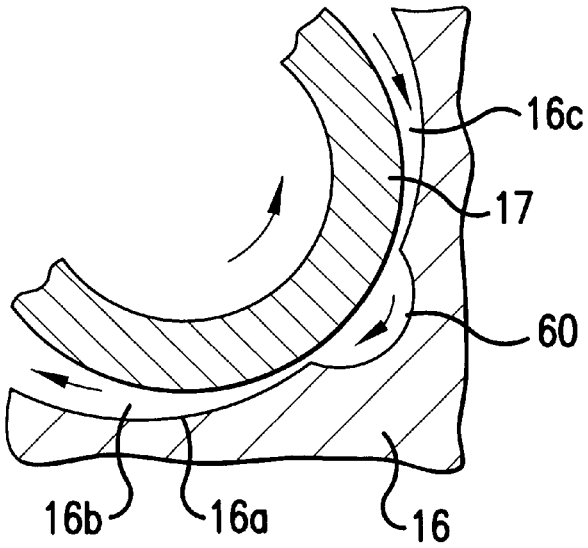
FIG. 5 is a sectional view of the rotary compressor of this invention, showing a flow of refrigerant within the cylinder provided with a bypass passage.

FIG. 4 is a sectional view, showing the cylinder and the eccentric roller of a rotary compressor in accordance with the preferred embodiment of the present invention. FIG. 5 is a sectional view of the rotary compressor of this invention, showing a flow of refrigerant within the cylinder provided with a bypass passage.

Figure 1:
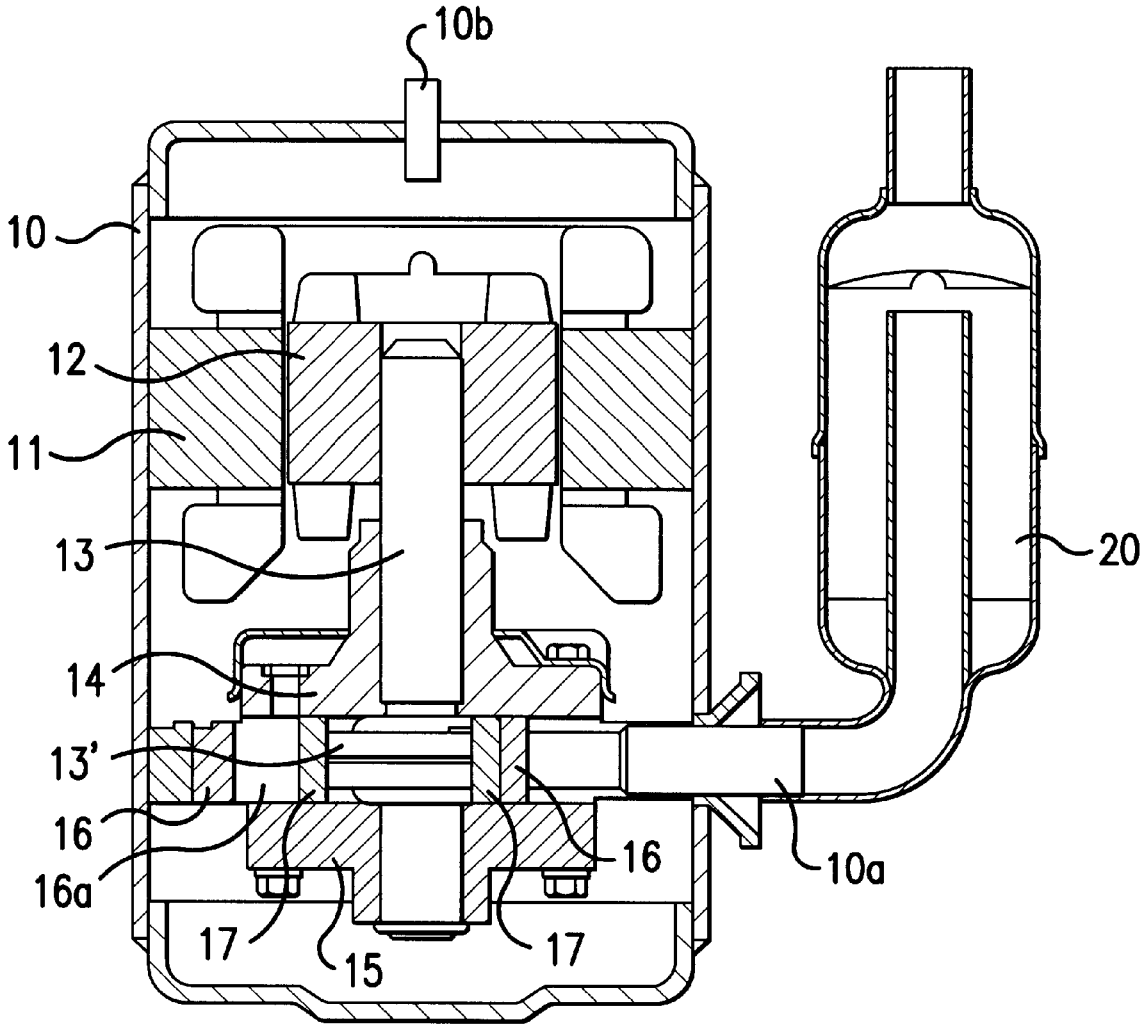
FIG.1 PRIOR ART
FIG. 1 is a sectional view, showing the construction of a conventional rotary compressor.
Figure 2:
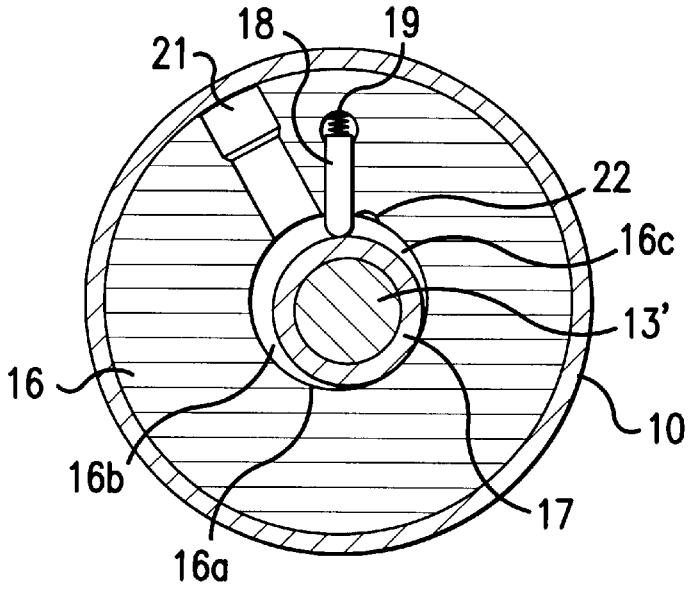
FIG.2 PRIOR ART
FIG. 2 is a sectional view, showing the cylinder and the eccentric roller of the conventional rotary compressor.
Figure 3:
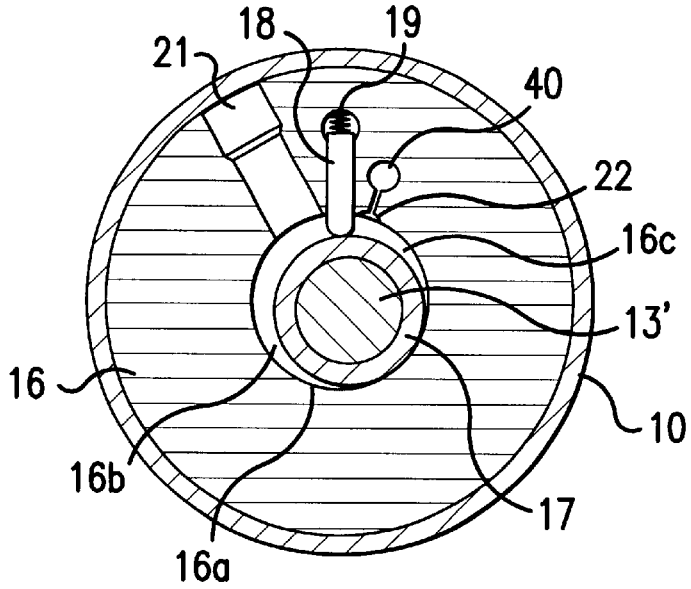
FIG.3 PRIOR ART
FIG. 3 is a sectional view corresponding to FIG. 2, showing a resonator installed within the cylinder of the conventional rotary compressor.

As shown in the drawings, the general shape of the rotary compressor according to the preferred embodiment of this invention remains the same as that of the conventional rotary compressor of FIG. 1, but a bypass passage 60 is formed on the internal surface of the cylinder 16 at a position around a refrigerant exhaust stroke initiating point spaced apart from the vane 18 at a counterclockwise angle θ.

That is, the rotary compressor according to the preferred embodiment of this invention comprises a casing 10 provided with the cylinder 16 therein. The cylinder 16 defines a bore 16*a* therein, with both a refrigerant suction port 21 and a refrigerant exhaust port 22 being formed on the cylinder 16. An eccentric roller 17, eccentrically fixed to the rotating shaft 13 of a rotor 12, is set within the cylinder bore 16*a*. This roller 17 is eccentrically rotated within the bore 16*a* and compresses refrigerant. A vane 18 is provided within the cylinder bore 16*a* while being normally biased by a spring 1p to elastically come into contact with the external surface of the roller 17. This vane 18 thus partitions the chamber, formed between the cylinder 16 and the roller 17, into a low pressure variable suction chamber 16*b* and a high pressure variable compression chamber 16*c*. The bypass passage 60 is formed by a groove, which is formed on the internal surface of the cylinder 16 at a position around the refrigerant exhaust stroke initiating point spaced apart from the spring-biased vane 18 at a counterclockwise angle θ. In the present invention, it is preferable to design the groove of the bypass passage 60 to have a depth of not larger than 20% of the height of the cylinder 16. At the refrigerant exhaust stroke initiating point, the roller 17 completely compresses the refrigerant within the compression chamber 16*c* and initially exhausts the compressed refrigerant from the cylinder 16 through the exhaust port 22 that is opened by an exhaust control valve (not shown).

In the present invention, the bypass passage 60 may be provided in the upper portion of the cylinder 16 around the main bearing 14 or in the lower portion of the cylinder 16 around the sub-bearing 15. Alternatively, two bypass passages 60 may be formed in the upper and lower portions of the cylinder 16.

In addition, the bypass passage 60 may be preferably formed on the internal surface of the cylinder 16 at a position within an area having a range of $\theta \pm 10°$.

In the rotary compressor of this invention, the refrigerant suction and exhaust strokes are alternately and periodically performed under the control of the exhaust control valve, which periodically opens and closes the exhaust port 22 of the compression chamber 16*c*. That is, the exhaust control valve opens the exhaust port 22 at a time the internal pressure of the compression chamber 16*c* becomes higher than the exhaust pressure, thus quickly discharging pressure pulsation from the compression chamber 16*c* into the interior of the compressor casing 10. In such a case, the compressor typically generates impact vibration and pulsation noise. However, the compressor of this invention has the bypass passage 60 on the internal surface of the cylinder 16 at a position around the refrigerant exhaust stroke initiating point spaced apart from the spring-biased vane 18 at the angle θ. Therefore, at the exhaust stroke initiating point, the remaining highly compressed refrigerant gas is fed back from the compression chamber 16*c* into the suction chamber 16*b* through the bypass passage 60, thus reducing the pressure pulsation. That is, at a time the roller 17 passes by the exhaust stroke initiating point of the angle θ with the exhaust control valve being opened, the high pressure compression chamber 16*c* communicates with the low pressure suction chamber 16*b* through the bypass passage 60. Therefore, the pressure pulsation of the highly compressed refrigerant gas is discharged from the compression chamber 16*c* into the low pressure suction chamber 16*b*, thus preventing a rapid pressure variation at a time the exhaust control valve is opened. Therefore, it is possible to prevent an undesired excessive compression of refrigerant gas at the initial stage of each exhaust stroke. This finally reduces both impact vibration and pulsation noise caused by such an excessive pressure variation.

In such a case, the refrigerant compression efficiency of the compressor may be undesirably reduced since the highly compressed refrigerant gas is fed from the compression chamber 16*c* back into the suction chamber 16*b* through the bypass passage 60. However, such a communication of the compression chamber 16*c* with the suction chamber 16*b* through the bypass passage 60 only continues for a very short time of the initial stage of each exhaust stroke. Therefore, the deterioration in compression efficiency of the compressor caused by the communication of the chambers 16*b* and 16*c* may be negligible particularly in comparison with that of the conventional compressor caused by undesirable excessive compression of refrigerant due to the resonator 40. In addition, different from the conventional compressor having the resonator 40, the compressor of this invention is free from any dead cavity, which is undesirably remained in the compression chamber 16*c* at the final stage of a compressed refrigerant exhaust stroke and is free from exhausting compressed refrigerant from the cylinder 16. Therefore, the compressor of this invention is free from any deterioration in its refrigerant compression efficiency caused by a re-expansion of completely compressed refrigerant.

Figure 6:
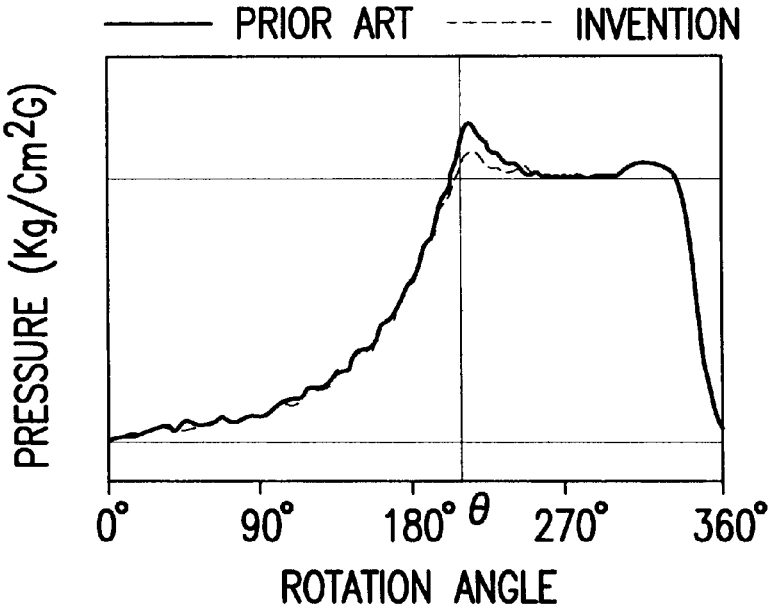
FIG. 6 is a graph, showing pressure as a function of rotating angle of the eccentric roller within the cylinder of the rotary compressor according to this invention in comparison with a conventional rotary compressor.
Figure 7:
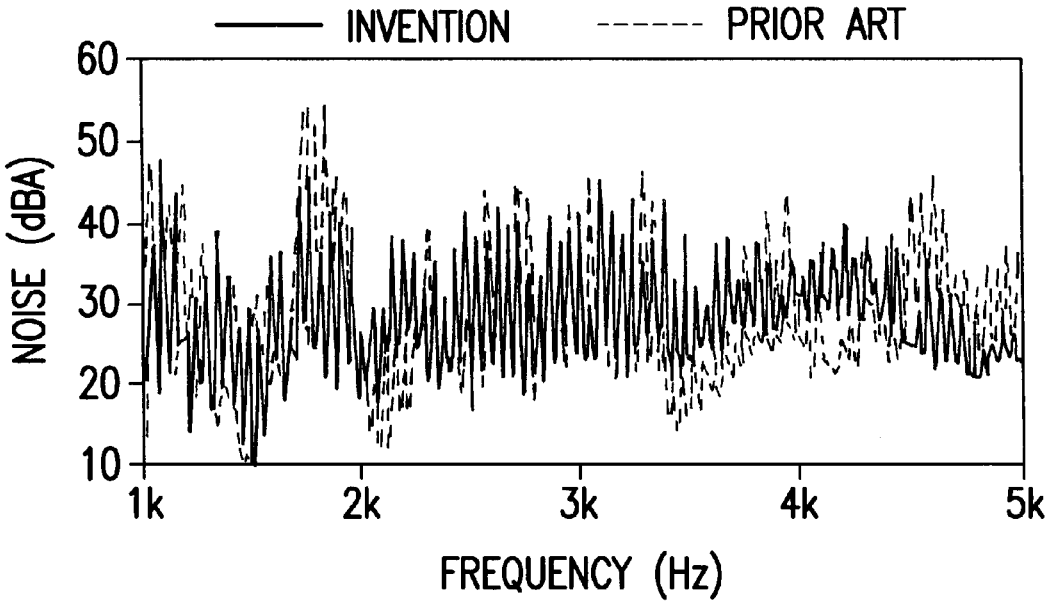
FIG. 7 is a waveform diagram, showing operational noise as a function of frequency of the rotary compressor according to the present invention in comparison with a conventional rotary compressor.

FIG. 6 is a graph, showing pressure as a function of rotating angle of the eccentric roller within the cylinder of the rotary compressor according to this invention in comparison with a conventional rotary compressor. FIG. 7 is a drawing showing operational noise as a function of frequency of the rotary compressor according to the present invention in comparison with a conventional rotary compressor. As shown in FIG. 6, the pressure of the rotary compressor of this invention at a position around the exhaust stroke initiating point of the angle θ is lower than that of the conventional rotary compressor, and so the compressor of this invention is free from excessive compression of refrigerant and is effectively reduced in its operational noise at the initial stage of each exhaust stroke. In addition, the graph of FIG. 7 shows that the compressor of this invention is remarkably reduced in its operational noise over a variety of frequency bands in comparison with the conventional rotary compressor.

As described above, the rotary compressor according to the invention has a bypass passage on the internal surface of the cylinder at a position around a refrigerant exhaust stroke initiating point spaced apart from the spring-biased vane at a counterclockwise angle θ, with the bypass passage allowing the compression and exhaust chambers to communicate with each other at the initial stage of each exhaust stroke. Due to such a bypass passage, pressure pulsation of highly compressed refrigerant gas is effectively discharged from the compression chamber into the suction chamber at the initial stage of each exhaust stroke, thus remarkably reducing a rapid pressure variation at a time the exhaust port of the cylinder is opened different from a conventional rotary compressor having a resonator at its cylinder. The bypass passage also prevents an undesired excessive compression of refrigerant at the initial stage of each exhaust stroke, thus finally reducing both impact vibration and pulsation noise caused by such an excessive pressure variation.

The rotary compressor of this invention is effectively reduced in its operational noise over a variety of frequency bands from a low frequency band to a high frequency band. Therefore, the operational noise of the compressor according to this invention is preferably reduced by 3 dB or more.

In the rotary compressor of this invention, the compression efficiency is almost free from excessive compression of refrigerant, thus being less likely to be reduced in its compression efficiency due to such excessive compression of refrigerant. Another advantage of the rotary compressor of this invention resides in that it is free from any dead cavity, which is undesirably remained in the compression chamber of its cylinder at the final stage of each exhaust stroke and is free from exhausting compressed refrigerant from the cylinder. The compressor of this invention is thus free from any deterioration in its refrigerant compression efficiency caused by a re-expansion of completely compressed refrigerant.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A rotary compressor comprising a casing, a rotating shaft set within the casing, a roller eccentrically fixed to the rotating shaft and rotatably, eccentrically set within a cylinder so as to form a variable suction chamber and a variable compression chamber within said cylinder, further comprising:

a bypass passage formed on an internal surface of the cylinder at a position within an area having a range of an angle of ±10° from a refrigerant exhaust stroke initiating point, thus allowing said compression and exhaust chambers to communicate with each other through the bypass passage at an initial stage of each exhaust stroke.

2. The rotary compressor according to claim 1, wherein said bypass passage is a groove formed on said internal surface of the cylinder.

3. The rotary compressor according to claim 2, wherein said groove has a depth of not larger than 20% of a height of said cylinder.

* * * * *